United States Patent [19]

Reiss

[11] Patent Number: 4,513,879

[45] Date of Patent: Apr. 30, 1985

[54] HOT/COLD FOOD DISPENSING MACHINE

[76] Inventor: Linda Reiss, 63 Austin Rd., Sudbury, Mass. 01776

[21] Appl. No.: 566,526

[22] Filed: Dec. 29, 1983

Related U.S. Application Data

[63] Continuation-in-part of Ser. No. 282,244, Jul. 13, 1981, Pat. No. 4,483,078.

[51] Int. Cl.[3] ..... G07F 11/72

[52] U.S. Cl. ..... 221/150 HC; 221/150 A

[58] Field of Search ..... 62/93; 222/108, 109, 222/146 HE; 221/124, 125, 133, 150 A, 150 HC

[56] References Cited

U.S. PATENT DOCUMENTS

| | | | |
|---|---|---|---|
| 2,695,015 | 12/1960 | Huchok | 99/327 |
| 2,755,000 | 7/1956 | Parre | 222/129.4 |
| 3,224,361 | 12/1965 | Ojelid | 99/332 |
| 3,308,261 | 3/1967 | Velander | 219/10.55 |
| 3,333,666 | 8/1967 | Murray et al. | 194/10 |
| 3,385,569 | 5/1968 | Bookout | 259/60 |
| 3,397,817 | 8/1968 | Smith | 221/150 |
| 3,416,429 | 12/1968 | Torsiello et al. | 99/327 |
| 3,531,019 | 9/1970 | Rodgers | 222/2 |
| 3,534,676 | 10/1970 | Rubino | 99/355 |
| 3,653,541 | 4/1972 | Crum | 221/150 HC |
| 3,768,553 | 10/1973 | Sollich | 62/93 X |
| 3,826,106 | 7/1974 | O'Hanlon et al. | 62/93 X |

*Primary Examiner*—Joseph J. Rolla
*Assistant Examiner*—Michael S. Huppert
*Attorney, Agent, or Firm*—Curtis, Morris & Safford

[57] ABSTRACT

A food dispensing machine for dispensing articles of food in either a heated or a non-heated state. A plurality of vertical disposed storage racks are disposed within a refrigerated chamber in the upper portion of the machine. At least one of the storage racks is adapted to deliver an article of food to a microwave oven, wherein the article of food is heated. After the heating cycle is completed, the heated article of food is delivered from the microwave oven to a receptacle bin. Individual selector mechanisms are provided to permit an operator of the dispensing machine to select either an unheated or a heated article of food. Alternatively, unheated articles of food are delivered directly from either of the storage racks to the receptacle bin, thereby bypassing the microwave oven. Provision is made for preventing moisture, generated upon heating of food in the microwave oven, from falling as condensation into the oven.

9 Claims, 7 Drawing Figures

HOT/COLD FOOD DISPENSING MACHINE

RELATED APPLICATION DATA

This is a continuation-in-part of my copending application Ser. No. 282,244, filed July 13, 1981 now U.S. Pat. No. 4,482,078.

BACKGROUND OF THE INVENTION

1. Field of the Invention

This invention relates to a food dispensing or vending machine, and particularly to a food dispensing machine which dispenses both hot and cold foods. This invention is more specifically directed to a coin-operated vending machine for dispensing food and selectively heating foods stored in a cold storage area prior to delivery to a customer.

2. Brief Description of the Prior Art

Coin-operated machines for dispensing various kinds of food and drink to a prospective customer are well known. It is often desirable to incorporate into a single machine foods which are dispensed either hot or cold, depending upon the choice of the purchaser. In machines which keep food continuously heated, the item of food has often been delivered to the purchaser in a soggy and unpalatable condition. This sogginess is caused by condensation within the sealed glassine or plastic wrapping about the item of food. It has also been the practice in such machines to display the items of hot food through glass windows, so that the prospective purchaser may select the type of food which he desires from visual inspection. Where the item of food has been stored in the dispensing machine for a period of time in a heated condition, it will often appear unappetizing to the customer, thus dissuading the customer from purchasing food from the machine. In machines where the customer is allowed to see the item of food, it is common to have a drum type of storage and delivery unit from which the customer removes the item of food through a door. This type of storage and delivery limits the capacity of the machine or, where greater storage capacity is desired, the machine must be enlarged to gargantuan proportions.

Where it is desired to dispense both hot and cold foods from the same machine, it has been the practice to have two separate storage chambers which must be sufficiently insulated from one another, and which must be separately heated and cooled. This necessitates provision of a separate heating unit and a separate cooling unit, thus increasing the bulk of the machine.

It has been previously proposed to utilize a microwave oven, infrared oven, or other food-heating device in conjunction with a cold-storage food vending machine to provide either hot or cold food, as desired by the purchaser at the time of purchase. One such arrangement is disclosed in U.S. Pat. No. 3,416,429. In that arrangement of a food vending machine, food articles are stored in a plurality of vertically disposed storage racks within a refrigerated chamber in the upper portion of the machine. At least one of the storage racks is situated so as to deliver an article of food to a microwave oven to be heated. After a heating cycle is completed, the heated article of food is delivered to a receptacle bin. Individual selector mechanisms permit the purchaser to select either a heated article, such as, for example, a heated roast beef sandwich, or a cold article, such as, for example, a tuna salad sandwich. The cooking chamber of the microwave oven is perforated, so that water vapor, generated by heating condensation or native moisture in the article, is permitted to escape. As a consequence, even though rapidly heated, the hot food is delivered with an attractive appearance and a palatable texture, and is prevented from becoming soggy.

However, the microwave oven is sensitive to stray moisture. While the above food vending machine includes a trap to prevent condensation within the cold storage compartment and prevent that moisture from dripping into the microwave oven, it does not include any provision to prevent the moisture generated upon heating a food article from condensing and dripping back into the oven. Thus, the vending machine will deliver properly heated food if there is sufficient time for the moisture to dissipate, but may begin to experience difficulties during heavy use periods, such as during lunch and supper periods. At those times, sufficient condensation can accumulate and drip down into the microwave oven to disturb the preset cooking cycle, or can affect some of the electronic circuitry.

OBJECTS AND SUMMARY OF THE INVENTION

It is an object of the present invention to provide a new and improved food dispensing machine which is capable of dispensing items of food in either a hot or a cold condition.

It is a further object of the present invention to provide a new and improved food dispensing machine which is compact and which has a substantial storage capacity.

It is yet another object of the present invention to provide a new and improved food dispensing machine which delivers an item of food to a purchaser in a fresh and palatable state, even during periods of frequent use.

It is still another object of the present invention to provide a new and improved food dispensing machine which stores pre-cooked food in a refrigerated state but which dispenses an item of food previously refrigerated in a heated state.

It is a yet further object of the present invention to provide a new and improved food dispensing machine wherein both condensation formed in the refrigerated storage space, and condensation formed between the heating and cooking unit and the refrigerated storage space are prevented from entering into the heating and cooking unit of the machine, while condensation formed during the cooking cycle is eliminated.

According to an aspect of this invention a hot-and-cold vending machine is constructed having a cabinet, with a refrigeration compartment topmost including storage racks for storing refrigerated articles of food; a food guide compartment therebelow having a selection mechanism, preferably coin-operated, for selecting an article of food from the refrigeration compartment and a guide arrangement for guiding such article generally downwards; and a food dispensing compartment below the guide compartment in which an article of food is received and prepared, and is thereafter presented to a purchaser. The food dispensing compartment includes a microwave oven, structure for receiving an article of food and depositing the same in the oven and automatically ejecting the article from the oven when a cooking and heating cycle has transpired. The oven is provided with perforated walls to permit water vapor to escape from the article to prevent it from acquiring a soggy texture or a displeasing appearance. Gates in the guide compartment close off the refrigeration compartment to keep condensation from dripping out into the microwave oven. The machine is further provided with an arrangement to keep the water vapor generated from the heated food articles from reentering the oven as condensate and adversely affecting the oven's operation. This arrangemment can include a fan or blower mounted on a wall within the guide compartment to blow the water vapor emanating from the oven to a part of the compartment where it will not affect the oven. The arrangement can also include a gate, or pan above the oven in the path of descending food articles. This gate can be easily pushed away when the article drops into the oven, but before such time, the gate acts to intercept any drops of condensed moisture that would otherwise fall into the cooking section of the oven.

Further objects, features, and advantages of this invention will become evident to those skilled in the art from the ensuing description and drawings.

DETAILED DESCRIPTION OF A PREFERRED EMBODIMENT

Figure 1:
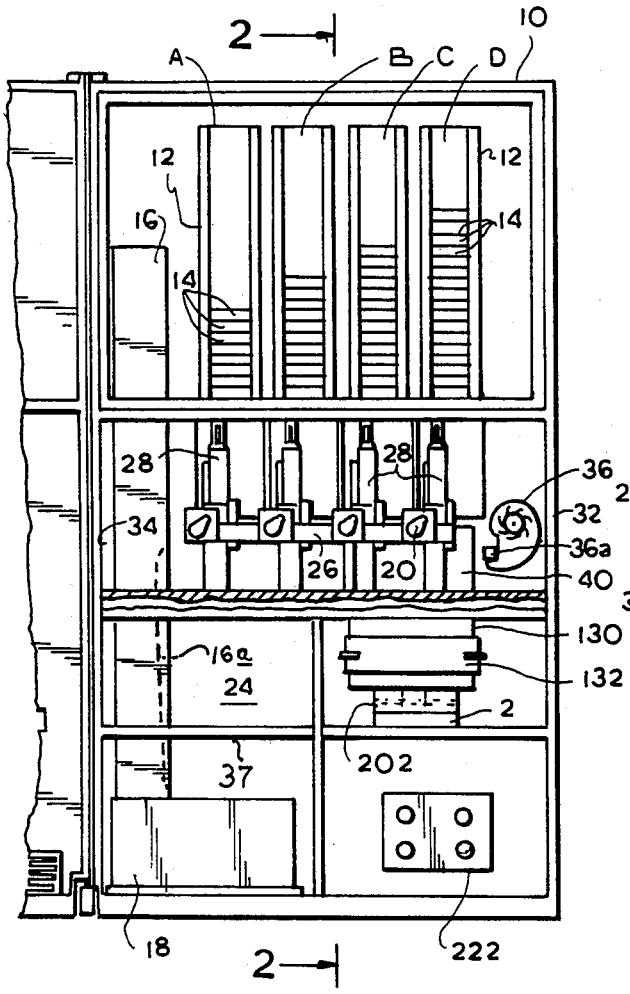
FIG. 1 is a front elevational diagrammatic view of the food dispensing machine of the present invention.
Figure 2:
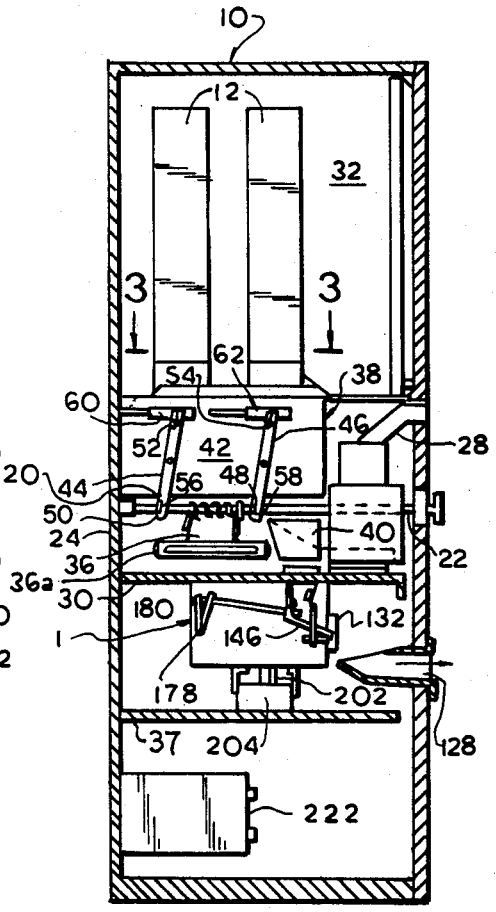
FIG. 2 is a side elevational diagrammatic view taken along line 2—2 of FIG. 1.

Referring now to FIGS. 1 and 2, there is shown diagrammatically a preferred embodiment of the present invention. As shown, a cabinet 10 is provided with a plurality of storage racks 12 for storing a plurality of articles of food. As shown, the articles of food are disposed in suitable containers such as boxes 14 stacked one on top of the other within storage rack 12. As shown, racks 12 are disposed in two rows, one row in the front and one row in the rear of cabinet 10. In this manner the racks are paired in lines A, B, C, and D. Lines A and B are adapted to deliver unheated articles of food to a receptacle bin, there to be removed by a purchaser. Lines C and D are adapted to deliver articles of food to a microwave oven, to be hereinafter described, thereafter to be delivered to a receptacle bin in a heated condition. A suitable selector mechanism to be described hereinafter permits a purchaser to select an article of food from either the front or rear rack of a pair in a line. Racks 12 may be of any suitable material such as metal and are open at the top to permit insertion of articles to be stored. Racks 12 are situated within a refrigerated chamber, refrigeration being accomplished by cool air being pumped into the upper portion of the refrigerated chamber through conduit 16 from refrigeration unit 18. Conduit 16 is positioned along the rear wall of cabinet 10 and provides extra storage apart from racks 12.

A selector mechanism 20 is provided for each pair of racks 12. Selector mechanism 20 comprises an operating member 22 journalled in rear wall 24 of cabinet 10 and longitudinal member 26 at the front of cabinet 10. Longtudinal member 26 is supported by coin mechanisms 28 which are in turn supported by a horizontal member 30 mounted on side walls 32 and 34 of cabinet 10. A blower 36 is mounted on the wall 32 and is directed to blow transversely towards conduit 16. On the outer surface of the conduit 16 is a channel **16*a* passing through a horizontal member 37 separating the food dispensing compartment from the compartment therebeneath where the refrigerating unit 18** is situated.

A forward and rearward pair of racks 12 are mounted on a chute frame 38 to be described in greater detail hereinafter. A lower chute assembly 40 is disposed below chute frame 38. Pivotally mounted on the side wall 42 of chute frame 38 are a pair of members 44 and 46. Members 44 and 46, respectively, have slots 48 and 50 at their lower ends, and slots 52 and 54 at their upper ends. Pins 56 and 58 on member 22 selectively engage either slot 48 of member 44 or slot 50 of member 46, depending upon the rotational position of member 22. Members 44 and 46 respectively slidably engage food ejector members 60 and 62 slidably mounted in side wall 42 of chute frame 38. The manner in which articles are ejected from racks 12 by members 60 and 62 will be described in greater detail hereinafter. In general, however, operating member 22, which is slidably and rotatably mounted within cabinet 10, selectively acts upon either member 44 or member 46 according to the rotational position to which a prospective customer has turned member 22. For example, if member 22 has been rotated to the right, pin 58 on member 22 will engage slot 50 of member 46, whereas pin 56 will be out of engagement with slot 48 of member 44. Forward movement of member 22 will cause rearward movement of member 62 by means of pivotally mounted member 46. As described hereinafter, member 62 will then engage an item of food to be dispensed, and force the item into chute frame 38 when member 22 is moved rearwardly.

Figure 3:
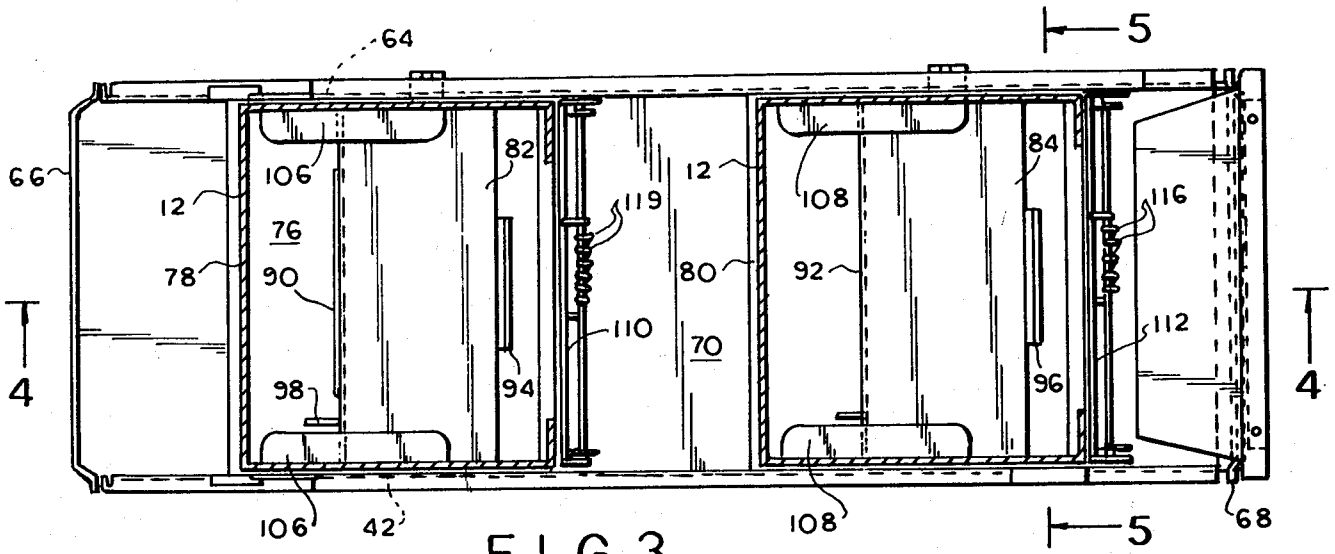
FIG. 3 is a partially sectional plan view taken along line 3—3 of FIG. 2.
Figure 5:
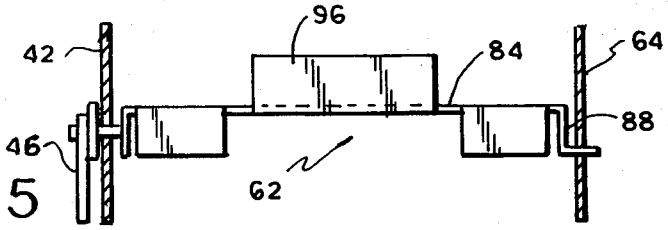
FIG. 5 is a partially sectional elevational view taken along line 5—5 of FIG. 3.
Figure 4:
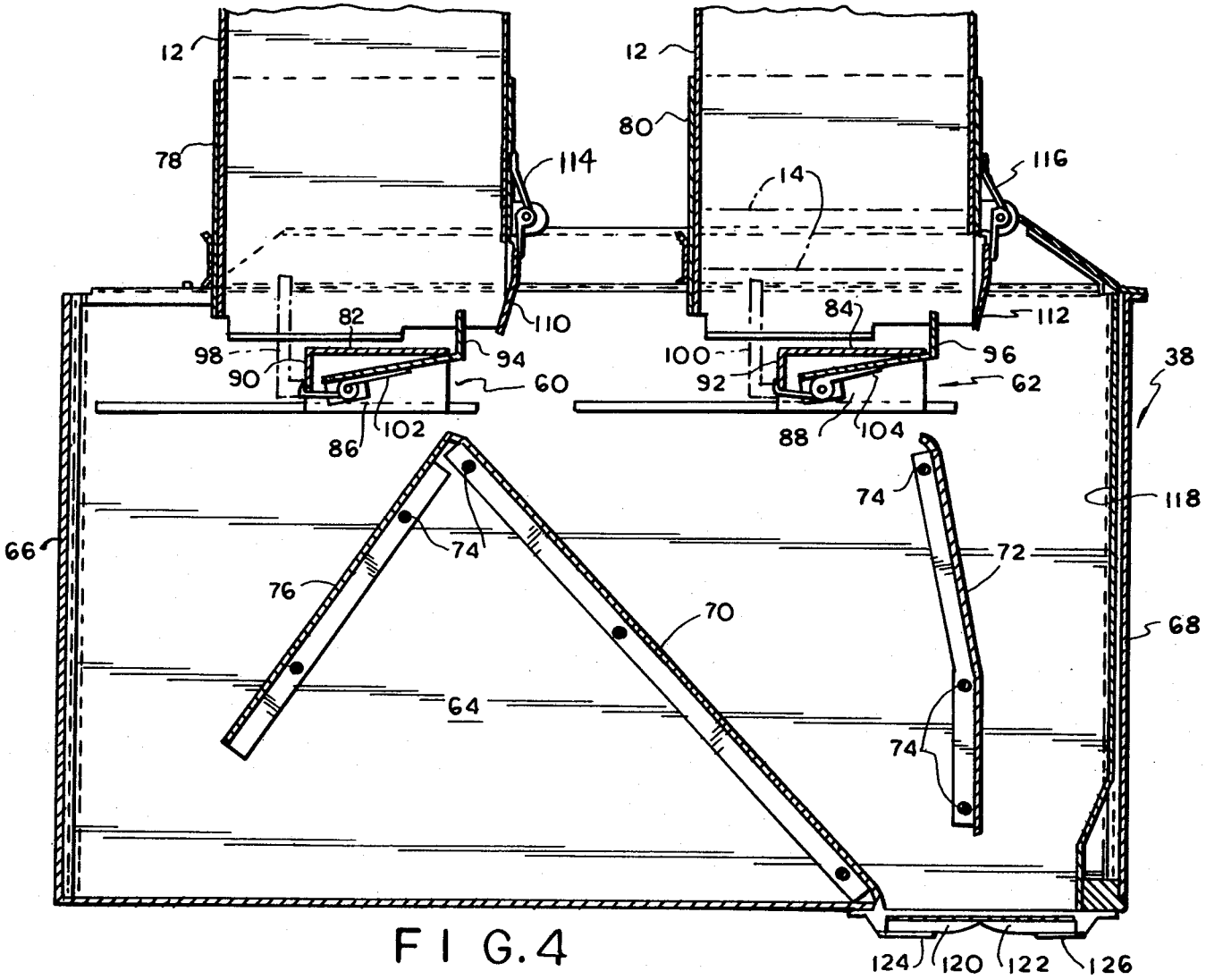
FIG. 4 is a partially sectional side elevational view taken along line 4—4 of FIG. 3.

Referring now to FIGS. 3, 4, and 5, there will be described in greater detail the chute frame 38 and the manner of ejection of articles from racks 12 into frame 38. As shown, chute frame 38 comprises side walls 42 and 64, rear wall 66 and front wall 68. Slides 70 and 72 are affixed to side walls 42 and 64 by suitable fasteners such as screws 74. Bracing member 76 is also mounted on side walls 42 and 64. Racks 12 are mounted on the top of frame 38 by being force-fitted into brackets 78 and 80 mounted on frame 38. This manner of mounting allows for easy removal and insertion of racks 12. As pointed out hereinabove, ejector members 60 and 62 are slidably mounted in side walls 42 and 64. As shown, members 60 and 62 respectively comprise transverse members 82 and 84, angled side members 86 and 88, rearward transverse members 90 and 92, ejection members 94 and 96, and angled locking members 98 and 100. Members 94 and 96 are journalled in the side walls of members 60 and 62 and spring biased upwardly by springs 102 and 104. Locking members 98 and 100 are also journalled on members 60 and 62 and are normally spring biased upwardly.

Oppositely disposed inwardly projecting seating members 106 and 108 are provided to hold boxes 14. Flop gates 110 and 112 are respectively pivotally mounted on the front wall of brackets 78 and 80. Gates 110 and 112 are normally biased rearwardly by springs 114 and 116.

Ejection of a box 14 from racks 12 is accomplished as follows: When member 22 has been rotated to operatively engage either member 44 or member 46, frontward and rearward movement of member 22 will cause frontward and rearward movement of either ejector member 60 or member 62. For example, if it is desired to eject a box 14 from front racks 12, operating member 22 would be rotated to operatively engage member 46.

Ejector member 62 is normally in the forward position. When racks 12 contain boxes 14, the weight thereof will press members 96 and 100 downwardly. Forward movement of member 22 will cause rearward movement of ejector member 62. Since locking member 100 is pressed downwardly, it will clear the rear wall of racks 12. When member 62 has been moved to its farthest position rearwardly (to the left as seen in FIG. 4), the upwardly projecting portion of ejector member 96 will clear the rear wall of box 14 with which it is in contact, and will be spring biased upwardly by spring 104. When member 22 is pushed rearwardly, member 62 will be caused to move forwardly. The front face of member 96 is caused to engage the rear face of lower box 14 in racks 12, thus to push it forwardly as member 62 moves forwardly. Forward movement of lowermost box 14 will cause gate 112 to swing counterclockwise. Eventually, box 14 will be pushed out of racks 12 by member 96 and will fall through the chute formed by front wall 118 of frame 38 and slide 72. Another box 14 will drop down, ready to be acted upon by member 62, box 14 pushing members 96 and 100 downwardly.

If the racks have been emptied of food boxes 14, locking member 100 will prevent rearward movement of member 62 by abutting against the rear wall of racks 12. This locking action will indicate to the customer that the selected item is sold out.

In similar manner, member 60 would act upon boxes stored in racks 12 to eject them onto slide 70.

After individual box 14 has been ejected from one of the racks 12, it will fall through chute frame 38 and force gates 120 and 122 open. Gates 120 and 122 are respectively normally biased closed by spring 124 and 126. Gates 120 and 122 are of heat insulating material to prevent condensation from dropping into the chamber below. As will be described hereinafter, a microwave heating and cooking oven is located beneath at least one chute frame 38. It is desirable to prevent condensation from dropping into the oven, so that the food in a container 14 may be properly cooked, and so that condensation does not short out the electrical power and control system associated with said oven. After a container has passed through gates 120 and 122, the gates will return to their normally biased closed position.

If a cold food article has been selected, the container 14 holding the article of food will drop into receptacle bin 128 (see FIG. 2) where it is removed by the purchaser. If, on the other hand, an article of food has been selected which is to be delivered to the purchaser cooked, the container 14 containing the article of food will fall through lower chute assembly 40 into microwave oven 130, where the article of food will be cooked and heated for a pre-determined amount of time. After the heating cycle has been completed, front door 132 of oven 130 will open into bin 128 for removal by the purchaser.

Figure 6:
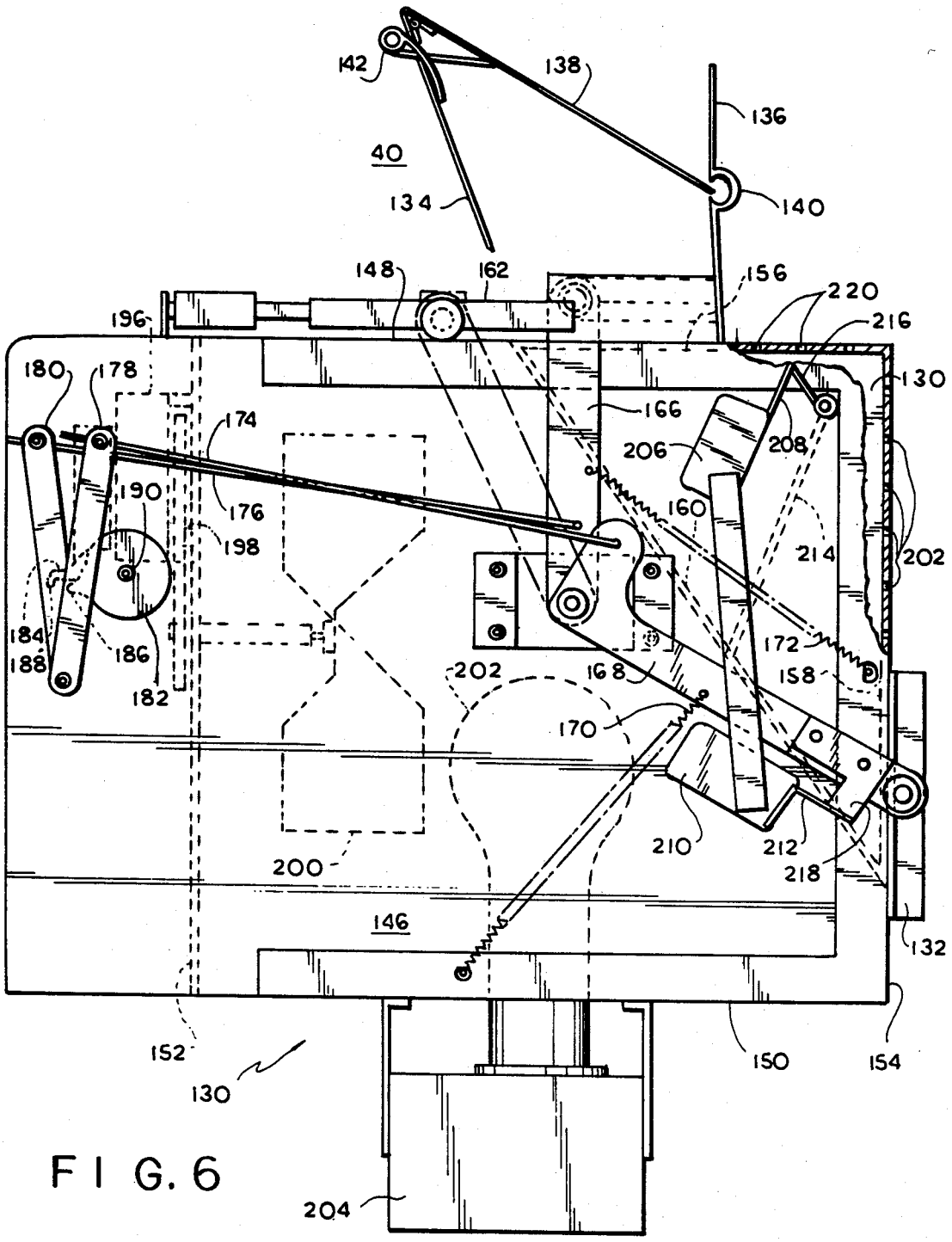
FIG. 6 is a partially sectional elevational view of the microwave oven of the present invention.
Figure 7:
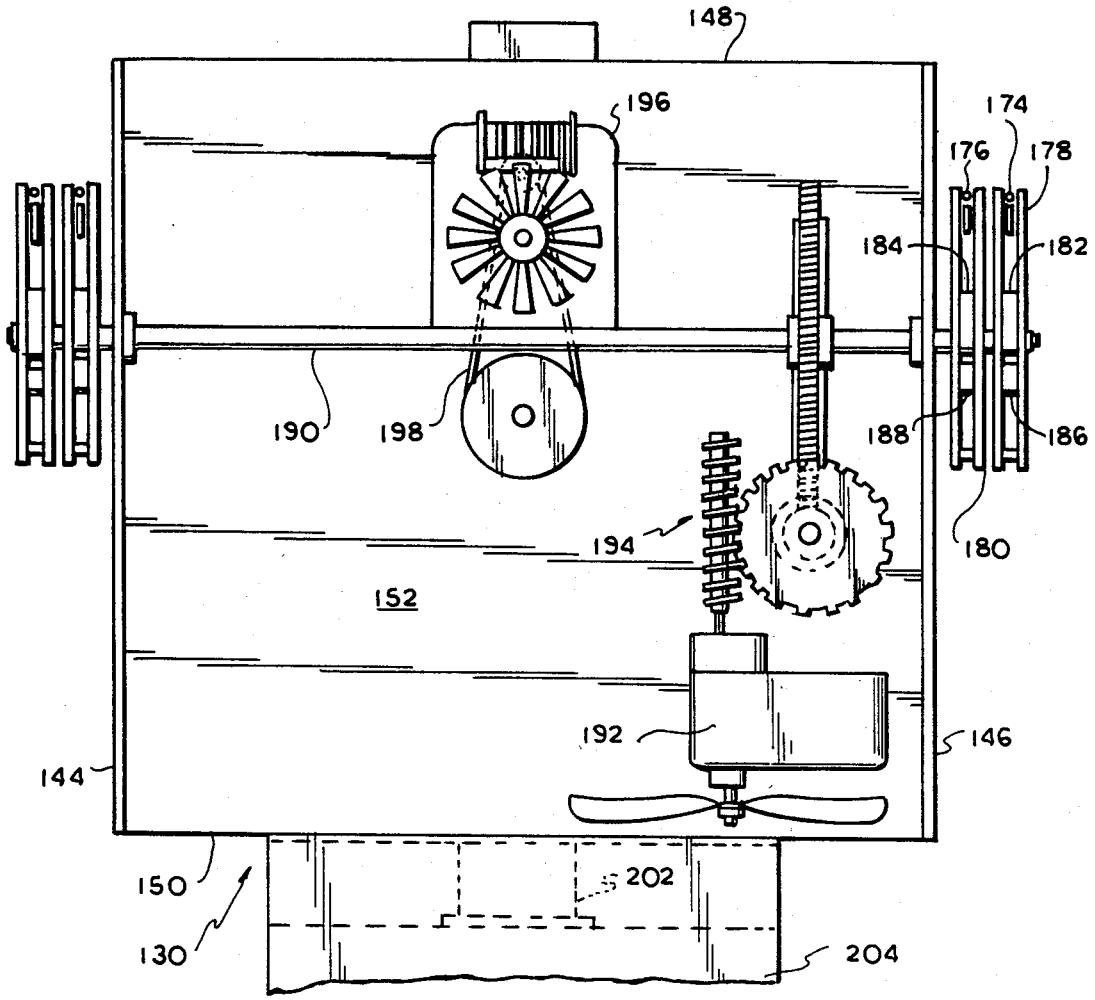
FIG. 7 is a rear elevational view of the oven of FIG. 6.

Referring now to FIGS. 6 and 7, microwave oven 126 will be described in greater detail.

Disposed above oven 130 is lower chute assembly 40 formed of a diagonal slide 134 disposed rearward and a vertical slide 136 disposed forward. A hinged gate 138 which can also be formed, like gates 120, 122 of any convenient material, catches condensation drips which form in the dispensing section below racks 12. Gate 138 is inclined downwardly toward slide 136 and carriers any drips to a recess 140 formed therein. A weak spring 142 biases gate 138 to its illustrated position, but permits an article of food, e.g., container 14, to swing gate 138 out of the way.

As shown, oven 130 comprises side walls 144 and 146, top wall 148, bottom wall 150, rear wall 152, and front wall 154. Walls 144–154 of oven 130 may be of any suitable rigid material such as aluminum or the like. Top wall 148 is provided with an opening 156 for the reception of a container 14 into oven 130. Front wall 154 is provided with an opening 158 to permit ejection of a container having an article of food which has been cooked by oven 130.

Disposed within oven 130 is a slide 160. Slide 160 is of a material which will allow microwaves to freely pass through with minimum loss of efficiency of the heating effect of the microwaves. Such a material, for example, would be fiber glass, polypropylene, or the like. It has been found that polypropylene is especially suitable in the instant application to provide the greatest heating efficiency.

Oven 130 is provided with a cover 162 for covering opening 156 in upper wall 148. In like manner, door 132 is provided to cover opening 158 in front wall 154. Cover 162 is mounted on a pair of arms 166 journalled in side walls 144 and 146 of oven 130. Door 132 is similarly mounted on lever arms 168, also journalled in side walls 144 and 146.

As shown in FIG. 6, door 132 is normally biased closed by the action of spring 170 on arm 168. Similarly, door 162 is normally biased closed by the action of spring 172 on arm 166. Counteracting these biasing forces are rods 174 and 176, respectively attached at their one ends to arms 168 and 166 and at their other ends to lever arms 178 and 180 journalled at the rear of wall 146. Cams 182 and 184, respectively bear upon cam followers 186 and 188 of arms 178 and 180.

Cams 182 and 184 are mounted on rotatable shaft 190 journalled in walls 144 and 146. A motor 192 is mounted on rear wall 150 and is linked to shaft 190 through a gear train 194. Thus, rotation of the rotor of motor 192 causes rotation of shaft 190 and cams 182 and 184 mounted thereon. The speed of motor 192 and the gear reduction ratio of gear train 194 determine the speed at which shaft 190 will rotate. As will be explained hereinafter, this speed determines the operation cycle of microwave oven 130.

A second motor 196 is mounted on rear wall 150 and is linked through drive belt 193 to a fan 200 disposed within oven 130. A microwave source 202 is also disposed within oven 130 and is powered by microwave energy source 204. Microwave source 202 may, for example, be a magnetron tube and energy source 204 the appropriate circuitry for powering said megnetron tube. Fans 200 acts to increase the efficiency of oven 130 during the heating and cooking cycles.

Microswitch 206 having arm 208 is mounted on wall 146 of oven 130. A second microswitch 210 having switch arm 212 is likewise mounted on wall 146.

Disposed within the heating chamber of oven 130, said heating chamber being formed by segments of walls 144, 146, 148, and 154, as well as slide 160, is a gate 214 journalled in walls 144 and 146. Gate 214 is provided with an arm 216 which bears against switch 208 of microswitch 206. Lever arm 168 is provided with a projecting member 218 which bears against switch arm 212 of microswitch 210. The function of switches 206 and 210 will be described hereinafter.

Microwave oven 130 operates as follows: Door 162 is normally maintained in the open position by the action of cam 184 bearing on follower 188 and thence acting to hold arm 166 back through arm 180 and rod 176. When a box 14 containing an article of food drops into oven 130, the box will strike gate 214, and thus actuate microswitch 206 through the action of arm 216 on switch arm 208. Actuation of microswitch 206 turns motor 192 on. The operation of motor 192 causes shaft 190 to rotate cam 184 out of contact with cam follower 188, thus allowing spring 172 to close door 162 over opening 156. Fan 200 and microwave source 202 will also be activated to provide cooking of the article within oven 130. The length of time of the heating and cooking cycle is determined by the nature of the food to be cooked. Normally, this time would last from ten to twenty seconds.

After the cooking cycle has been completed, cam 182 will have to rotate into engagement with cam follower 186. Further rotation of cam 182 causes lever arm 178 to act upon door 132 through rod 174 and arm 168 to open door 132 and allow the cooked article of food to fall by gravity out of oven 130.

Meanwhile, cam 184 has re-engaged itself with cam follower 188 to re-open door 162 in preparation for the next cooking cycle. Disengagement of member 218 from switch 212 actuates switch 210 to deactivate motors 192 and 196 and microwave source 202. Meanwhile, cam 182 has disengaged from cam follower 186 and door 132 has been allowed to its normally biased closed position.

In order to reduce condensation during the heating and cooking cycle, perforations 220 are provided in the walls forming a part of the heating chamber, i.e., walls 144, 146, 148, and 154. These perforations allow any condensation formed to evaporate therethrough and thus to keep the article of food crisp and free from sogginess.

Supplemental blower 36 cycles in response to operation of oven 130. Moisture generated by heating of the article of food passes upward through perforations in walls 144, 146, 148, and 154, but is blown from above oven 130 and is not permitted to condense there. Instead, such moisture will condense in the vicinity of cold air conduit 16, where it will not affect operation of oven 130. The moisture condensing thereat flows down the channel **16*a* to the refrigerating unit 18**, i.e., out of the food dispensing compartment. There, the moisture can evaporate harmlessly.

Blower 36 is controlled by microswitch 206 to operate during the cooking cycle. Preferably, blower 36 is adapted to continue running for a brief period thereafter (e.g., 30 seconds) to cause any remaining moisture to be conducted away from oven 130. As shown in FIG. 2, blower 36 has an elongated mouth **36*a* extending generally across top wall 148 of oven 130. The opening of the mouth 36*a* is elongated in the direction across the oven 130** (i.e., the horizontal direction).

Gate 138 prevents any moisture that may condense below gates 120, 122 from reaching oven 130, and complements the action of blower 36, as the conduction of blown air is partially obstructed by the position of lower slide assembly 40.

Cabinet 10 is provided with a power supply 222 for supplying the power necessary for effectuating the power and control functions of the food dispensing machine.

In summary, the food dispensing machine described hereinabove operates as follows: Indicated on the front of the machine are various articles of food stored within the machine. As shown in FIGS. 1 and 2, eight storage racks are provided, four racks for storing articles of food which are to be dispensed in the cold state, and four racks for storing articles of food which are to be dispensed in a cooked state. During storage, all of the articles of food are kept refrigerated in order to maintain their freshness.

When a prospective purchaser desires to purchase an individual article of food, he inserts the proper coin combination within the coin mechanism 28 associated with the article of food desired. Insertion of the coin mechanism 28 allows the customer to operate the apporopriate selector member 22. If a cold article of food is desired, actuation of member 22 will eject the desired article of food from the appropriate storage rack 12 into bin 128.

When the article of food selected is to be heated, actuation of member 22 will cause the appropriate container of food to drop into microwave oven 130. Oven 130 will be thereby activated and the predetermined cooking cycle will take place. When the cooking cycle has ceased, door 132 will open to eject the cooked article into bin 128.

Although a preferred embodiment of the present invention has been described hereinabove, it will be understood that modifications well known to those skilled in the art may be made within the scope of the present invention. For instance, although eight storage racks have been shown, it will be understood that any number less or more than eight are contemplated to be within the present invention, and said invention is not to be limited by the specific number of storage racks. In like manner, although a specific selector mechanism has been described, it will be understood that any suitable mechanism or electrical selector mechanism may be substitued therefor.

It will thus be seen that the food dispensing machine of the present invention is highly compact and is adapted to dispense both hot and cold articles of food. The articles of food during storage are kept in a refrigerated state, thus assuring freshness when the article is dispensed to a prospective customer. When the article of food to be dispensed is to be cooked, the microwave oven of the present invention quickly cooks the food and prevents the article of food from becoming soggy due to condensation during the cooking cycle, thus providing for dispensing of hot food which is both palatable and appealing to the eye. Means are provided in the present invention for insulating the refrigeration compartment, and keeping moisture condensing in the refrigeration compartment from dropping into the oven from the refrigeration compartment, thus eliminating breakdown of the oven due to short-circuiting or the like. Means are also provided to prevent evaporated moisture generated during a cooking cycle from condensing and dripping back into the oven, thus minimizing the prospect of oven misoperation due to stray moisture, especially during periods of frequent use.

Although preferred embodiments of the present invention have been described hereinabove, it will be understood that the scope of the present invention is not be limited by such embodiments, but rather is to be determined by the appended claims.

I claim:

1. In a food dispensing machine comprising a cabinet, a refrigeration compartment disposed in an upper portion of said cabinet, including storage means in said refrigeration cabinet compartment storing articles of food, a food guide compartment disposed in a central portion of said cabinet, including selection means for selecting an article of food from said storage means and guide means for guiding such article generally downwards; and a food dispensing compartment disposed in said cabinet below said food guide compartment, including a microwave food heating device for selectively automatically heating articles of food, as desired by a user, means for receiving an article of food from said guide means and depositing the same into a cooking section of said microwave food heating device, means for controlling a heating and cooking cycle of said device in response to said article of food being so deposited into said cooking section, means for automatically ejecting the heated article of food at the end of a heating and cooking cycle, receptacle means for receiving the ejected article and presenting the same to the user, means for permitting evaporated moisture generated during a heating and cooking cycle to escape from said cooking section, and means in said refrigeration compartment preventing condensed moisture forming therein from dripping into said food guide compartment; the improvement wherein said food guide compartment includes a blower disposed above said microwave food heating device for blowing evaporated moisture generated during a heating and cooking cycle from above said microwave food heating device to another section within said food guide compartment where the evaporated moisture can condense, condensing means in said other section for condensing said evaporated moisture, and means conducting the condensed moisture out of said other section of said food guide compartment, the blower and the conducting means thus preventing such moisture from dripping, as condensate, into said microwave food heating device, thereby minimizing the prospect of moisture-caused misoperation during periods of repeated use.

2. A food dispensing machine according to claim 1, wherein said blower has an exhaust mouth that is elongated to extend generally across the top of said microwave food heating device, so that moisture emanating therefrom is conducted efficiently away.

3. A food dispensing machine according to claim 1, wherein said means for preventing also includes means for switching said blower on at the onset of operation of said microwave food heating device, and for switching said blower off thereafter.

4. A food dispensing machine according to claim 3, wherein said blower continues to operate for a short interval after the end of operation of said device.

5. In a food dispensing machine comprising a cabinet, a refrigeration compartment disposed in an upper portion of said cabinet, including storage means in said refrigeration compartment storing articles of food; a food guide compartment disposed in a central portion of said cabinet, including selection means for selecting an article of food from said storage means and guide means for guiding such article generally downwards; a food dispensing compartment disposed in said cabinet below said food guide compartment, including microwave food heating device for selectively automatically heating articles of food, as desired by user, means for receiving an article of food from said guide means and depositing the same into a cooking section of said microwave food heating device, means for controlling a heating and cooking cycle of said device in response to said article of food being so deposited into said cooking section, means for automatically ejecting the heated article of food at the end of a heating and cooking cycle, receptacle means for receiving the ejected article and presenting the same to the user, means for permitting evaporated moisture generated during a heating and cooking cycle to escape from said cooking section, a cold air conduit extending through said food guide compartment near one side wall of the cabinet to deliver chilled air to said refrigeration compartment, and means in said refrigeration compartment preventing condensed moisture forming therein from dripping into said food guide compartment; the improvement wherein said food guide compartment includes means for preventing evaporated moisture generated during a heating and cooking cycle from dripping, as condensate, into said microwave food heating device, thereby minimizing the prospect of moisture-caused misoperation during periods of repeated use, the last-mentioned means for preventing including blower means mounted near a side wall opposite said one side wall and disposed above said microwave food heating device, and said blower means being operative to direct a stream of air generally toward said cold air conduit to conduct evaporated moisture, emanating from said cooking section and entrained in said stream of air, away from said microwave food heating device to said cold air conduit, and conducting means on said cold air conduit for conducting the condensed moisture out of the food guide compartment to another compartment in the cabinet where the moisture can condense without adversely affecting operation of the food dispensing machine.

6. A food dispensing machine according to claim 5, wherein said blower means has an exhaust mouth that is elongated to extend generally across the top of said microwave food heating device, so that moisture emanating therefrom is conducted efficiently away.

7. A food dispensing machine according to claim 5, wherein said means for preventing also includes means for automatically switching said blower means on at the onset of operation of said microwave food heating device, and for automatically switching said blower means off thereafter.

8. A food dispensing machine according to claim 7, wherein said blower means continues to operate for a short interval after the end of operation of said device.

9. A food dispensing machine according to claim 5, wherein said food dispensing machine includes refrigeration means having a refrigeration unit disposed in a compartment beneath said food guide compartment and separated therefrom by a partition; the cold air conduit extending from said refrigeration unit upwards through said partition and said food guide compartment into said refrigeration compartment; and said conducting means includes channel means along said conduit through said partition to permit the condensed moisture to flow towards said refrigeration unit.

* * * * *